United States Patent [19]

Lewin

[11] 4,383,289

[45] May 10, 1983

[54] TASK LIGHTING FIXTURE FOR CONCENTRATING ILLUMINATION

[76] Inventor: Ian Lewin, 11408 St. Andrew's Way, Scottsdale, Ariz. 85254

[21] Appl. No.: 216,364

[22] Filed: Dec. 15, 1980

[51] Int. Cl.[3] ..... A61G 13/00

[52] U.S. Cl. ..... 362/33; 362/216; 362/217; 362/297; 362/346; 362/347

[58] Field of Search ..... 362/33, 216, 217, 297, 362/346, 347

[56] References Cited

U.S. PATENT DOCUMENTS

| | | | |
|---|---|---|---|
| 3,363,093 | 1/1968 | Schmitt | 362/347 |
| 3,382,357 | 5/1968 | Welty | 362/347 |
| 3,748,460 | 7/1973 | Price | 362/347 |
| 4,161,767 | 7/1979 | Benasutti | 362/33 |

*Primary Examiner*—Stephen J. Lechert, Jr.
*Attorney, Agent, or Firm*—LaValle D. Ptak

[57] ABSTRACT

A task lighting fixture is provided for concentrating illumination on a work area beneath and offset to the side of the fixture. To accomplish this, an open reflector having a specular surface is mounted above and off to one side of the area to be illuminated. Transverse parallel vertical cross sections of the fixture are identical and comprise short and long compound curves joined together to form a cusp. The long compound curve extends toward the work area on which the illumination is to be concentrated. A U-shaped fluorescent bulb has each leg parallel to the cusp and the axes of the legs each are located on lines dissecting the cusp of the reflector.

7 Claims, 4 Drawing Figures

TASK LIGHTING FIXTURE FOR CONCENTRATING ILLUMINATION

BACKGROUND OF THE INVENTION

Over the past several years, the development of office furniture increasingly has been directed to modular units in the form of preassembled integral components. These components then are fitted together to provide work areas, storage spaces and partial room dividers for separating the work areas of different employees. Modular units are popular because they result in maximum efficiency in the utilization of a work space and permit a wide variety of arrangements to accomodate a correspondingly wide variety of work environments. As departments grow (or shrink) in size, additional units or rearrangement of units is readily accomplished without major construction or reconstruction which otherwise would be required for offices with fixed partitions.

In the development of modular office furniture, the integrated units often include a lower work area or desk area constructed with an upper storage area for books, papers, or the like. The upper area sometimes includes what is known as a "task light" fixture built into it for the purpose of illuminating the desk or work area below.

Generally, task light fixtures use fluorescent light bulbs in various arrangements to provide the desired illumination. Fluorescent bulb fixtures are desirable for a number of reasons. Fluorescent lamps use less energy for a given light output and run substantially cooler in temperature than conventional incandescent bulbs. In addition, fluorescent fixtures generally are shallower than incandescent fixtures. This is particularly desirable for a modular office work area system; so that the light fixture does not occupy space which otherwise can be used for bookshelves, storage, or the like, in the upper portion of the unit.

To minimize glare, both directly from the fixtures and from the work area below, it has been found desirable to place fixtures on the left and right sides of the work area in preference to a fixture which is located directly above the primary work area of the desk or table beneath it. Consequently, it is common to use two task lamp or task light fixtures on opposite sides of the work area. Direct glare from the fixtures is eliminated by having baffles, shields, or the like, extending downwardly from the fixture to cut off direct view of the bulbs in the fixture from a person sitting at the work area. To eliminate light and dark zones from the fixture projected onto the work area, it generally has been a practice to place diffuser plates or lenses over the fixture to spread the light emanating from it onto the work area. Diffuser plates, while they do accomplish the purpose of spreading the light, result in a reduction in the overall efficiency of the light output from the fixture.

Another disadvantage which occurs with task light fixtures placed above opposite ends of the work area is that such fixtures provide the best illumination of the area immediately below the fixture, with the illumination diminishing in the center of the work area. It is in the center of the work area, however, where concentration of the light should be, since this generally is the area of a modular unit in an office system where most of the work is done by a person using the module.

Task light systems of the prior art which have been developed for illuminating a work area below the fixture are disclosed in the patents to Shemitz, U.S. Pat. No. 4,054,793, issued Oct. 18, 1977, and Benasutti et al., U.S. Pat. No. 4,161,767, issued July 17, 1979. The Benasutti patent is directed to a task light which utilizes a pair of relatively wide-legged, U-shaped fluorescent bulbs mounted in a flat fixture above a work area. No concentration of light coming from the opposite sides of the work area is accomplished, and the fixture primarily relies upon direct lighting from the bulbs onto the work area below.

The Shemitz patent discloses a task light using a single fluorescent bulb extending across the width of the work area. The light from the fixture is directed from the rear of the work area onto it; and because of the orientation of the bulb, can result in light being reflected from the work area into the eyes of a person sitting at that area.

Two other patents which disclose light fixtures for illuminating a surface below the fixture are the patents to Doane, U.S. Pat. No. 2,240,179, issued Apr. 29, 1941, and U.S. Pat. No. 2,560,281, issued July 10, 1951. The Doane '179 patent is a symmetrical fixture using stacked fluorescent bulbs for spreading the light beneath the fixture uniformly. This patent does not disclose a fixture which is intended to concentrate the light off to one side of the fixture.

The Doane '281 patent is directed to a fixture for projecting the light emanating from it off to one side of the fixture. The arrangement of the bulbs and the configuration of the reflector in this fixture, however, results in considerable loss of light reflected back into the fluorescent bulbs, and, in addition, the fixture employs movable shields which will tend to block some of the light from the fixture, further reducing its efficiency.

It is desirable to provide a task light fixture which has maximum efficiency in terms of light output for the energy consumed by the fixture, as well as which concentrates the light at the center of the work area, where it is most needed, without reflection into the eyes of the person sitting or standing at the work area. In addition, it is desirable to provide such a fixture which overcomes the disadvantages of the prior art fixtures described above.

SUMMARY OF THE INVENTION

It is an object of this invention to provide an improved task light fixture.

It is another object of this invention to provide an improved task light fixture for concentrating light on a work area below and offset to one side of the fixture.

In accordance with a preferred embodiment of this invention, a lamp fixture is constructed for concentrating illumination in an area beneath the fixture and offset to the side of the fixture. This is accomplished with an open reflector, the transverse vertical cross sections of which are identical. The reflector cross sections comprise short and long compound curves joined together to form a cusp which is located behind an elongated fluorescent bulb in a manner such that the axis of the bulb is parallel to the cusp and the axis of the bulb is located on a line which dissects the cusp. The long compound curve of the reflector extends toward the area on which the illumination is to be concentrated.

DETAILED DESCRIPTION

Figure 1:
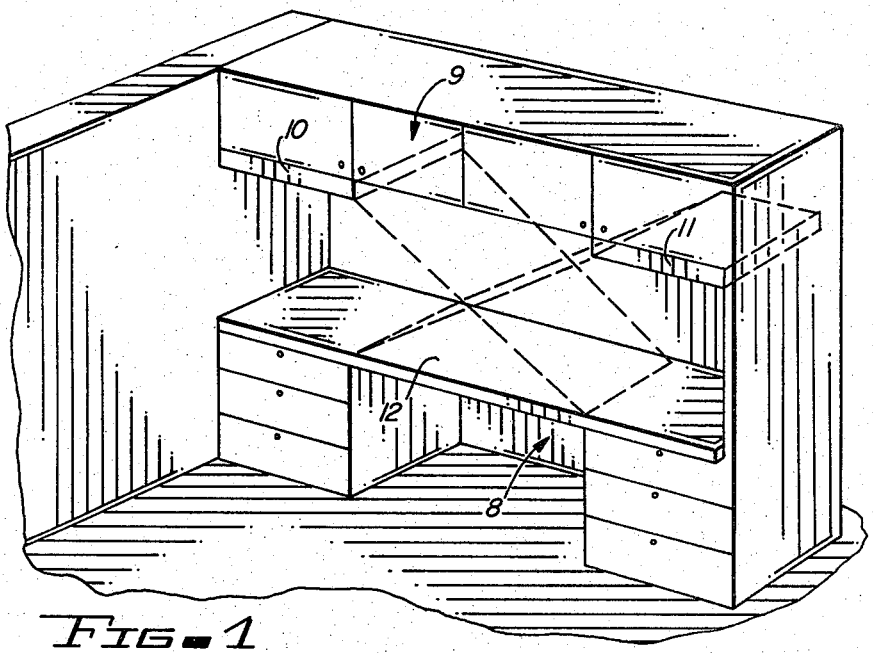
FIG. 1 is a perspective view of a modular office work station in which a task lamp fixture of a preferred embodiment of the invention is used.

In the drawing, the same reference numbers are used in the various figures to designate the same or similar components.

A typical work station in which the task lamp fixture of this invention may be used is illustrated in FIG. 1. The work station comprises a desk unit 8 having an upper top or work surface 12. Integrally constructed with the desk unit 8 and attached to it by a pair of vertical side walls is an upper storage unit 9. The storage unit 9 is supported a convenient distance above the top of the work surface 12, and typically has storage cabinets in it or bookshelves, depending upon the desires of the user of the work station. Underneath these upper cabinets or bookshelves, on the left-hand and right-hand ends of the modular unit, are a pair of task lamp fixtures 10 and 11. These fixtures use fluorescent bulbs to provide the desired illumination of the work surface 12 and are constructed to concentrate the light emanating from them on the center portion of the work surface 12, as indicated by the dotted lines in FIG. 1. Light also is directed by each of the fixtures 10 and 11 onto the surface 12 of the work area immediately beneath the fixtures, but since most work normally is done in the center of the work area, the concentration of the output of light from the fixtures is designed to fall on this central area.

Figure 2:
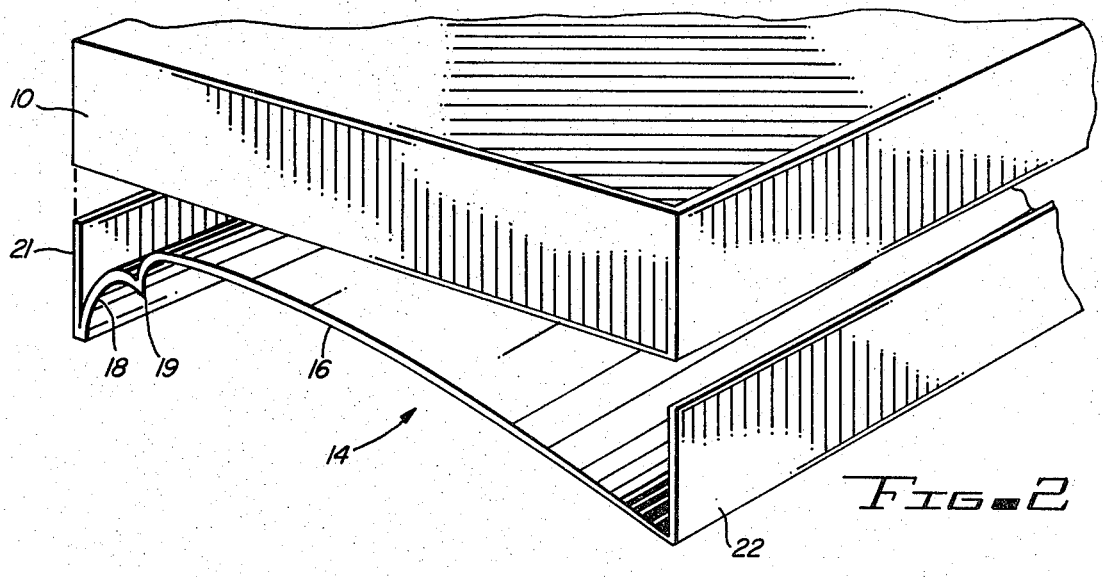
FIG. 2 is a partially exploded perspective view of a fixture in accordance with a preferred embodiment of the invention.
Figure 3:
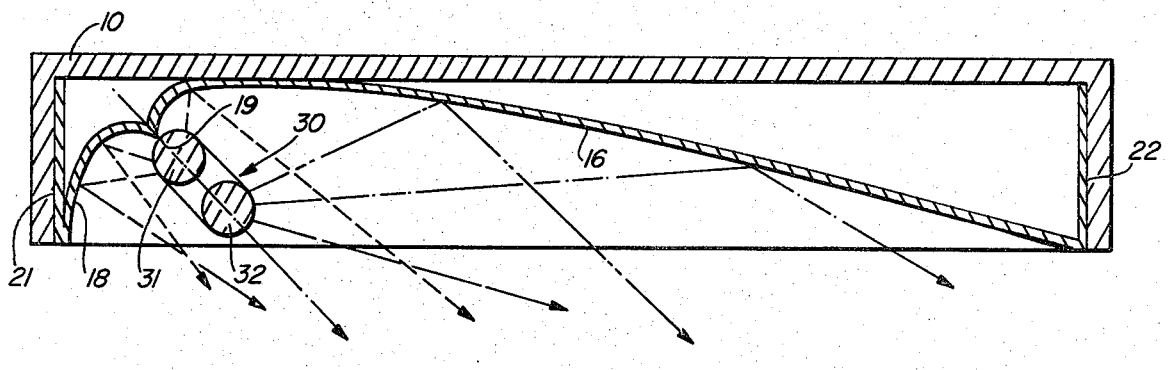
FIG. 3 is a cross-sectional view of the preferred embodiment of the invention.

To accomplish the desired concentration of the light output from the fixtures 10 and 11 onto the center of the work area 12, the fixture is constructed in the manner most clearly shown in FIGS. 2 and 3. The housings 10 and 11 are identical, and for that reason, only the housing 10 and its associated components have been illustrated in detail in FIGS. 2 and 3. The housing 11 is made, however, as a mirror image of the housing 10; so that the asymmetrical projection or concentration of light from the fixtures 10 and 11 is directed to the center of the work area. In all other respects, the fixture 11 is the same as the fixture 10.

The housing for the fixtures 10 and 11 comprises essentially a shallow, rectangular box, as illustrated in FIGS. 2 and 3. The wiring to the box for the fluorescent bulb placed within it is not shown, but is conventional. The reflector 14 for concentrating the light preferably is formed from a single sheet of material having a specular surface facing the fluorescent bulb used in the fixture. The reflector conveniently may be formed of a single sheet of aluminum or other suitable material which provides the desired reflective characteristics.

As illustrated in FIGS. 2 and 3, the reflector 14 has a pair of end walls 21 and 22 which fit into and are attached to the corresponding end walls of the housing 10. The end walls 21 and 22 extend from front to back of the work surface 12 above which the fixture is located, as illustrated in FIG. 1. All cross sections of the reflector 14 which are taken parallel to the walls 21 and 22 are straight lines parallel to the work surface 12 of the desk 8. FIG. 3 shows the cross sections of the reflector 14 which are perpendicular to the end walls 21 and 22, and illustrates the structure of the reflector 14. The reflector 14 comprises two compound curves, a long compound curve 16 and a relatively short compound curve 18, both coming together at a cusp 19.

Figure 4:
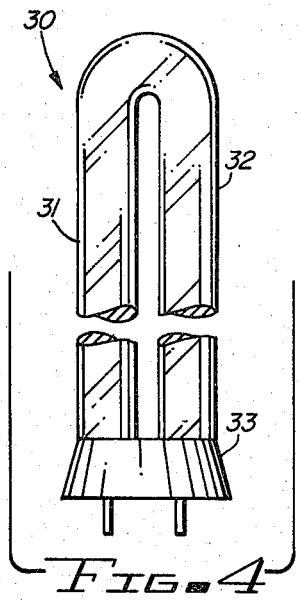
FIG. 4 illustrates details of a fluorescent lamp which may be used in the embodiment shown in FIG. 3.

To obtain maximum light output from each of the fixtures 10 and 11, a single socket, U-shaped bulb 30 is mounted in the fixture with the orientation of the legs of the bulb, as illustrated in the cross section view of FIG. 3. The bulb itself has two legs, 31 and 32, which are interconnected as illustrated in FIG. 4. The open or terminating ends of the legs 31 and 32 are attached to a single socket 33, which is connected to a source of operating power for the bulb. A typical, commercially available bulb for this purpose is Panasonic, model number FUL14. This is a fourteen (14) watt bulb, having an overall length of eight inches (which is a very convenient depth for the fixtures 10 and 11). By utilizing this type of bulb, it is possible to obtain a higher wattage output in a space which is nearly the same as that required for a conventional eight watt single bulb. The fixture shown in FIG. 3 could be used with two separate parallel bulbs or with a single fluorescent tube-type of bulb in place of the U-shaped bulb shown; but the bulb described provides maximum light output in a minimum space.

The axes of the legs 31 and 32 of the bulb 30 each are aligned with a line dissecting the cusp 19 where the two portions of the reflector 14 intersect one another. This line is substantially parallel to the direction of the offset beam of light produced by the fixture (as shown in FIG. 3). This may be a common line or two different lines forming an angle of up to 10 degrees between them. This causes the light output from the bulb 30 primarily to be obtained from the reflected light impinging upon the two compound curves 16 and 18 of the reflector. The direct light from the two legs 31 and 32 of the bulb 30 primarily is directed to the area of the work surface 12 located immediately beneath the extreme left-end of the fixture 10 (or the extreme right-end of the mirror image fixture 11). The fixtures 10 and 11, however, employ the reflective surfaces 16 and 18, which are oriented to throw or concentrate most of the light emanating from the bulb 30 onto the central area of the work surface 12, as shown in FIG. 1. The manner in which this is done is illustrated by the dotted lines and dot-dash lines representative of reflected light from the two legs 31 and 32 of the bulb 30, as illustrated in FIG. 3. The curvatures of the compound curve sections 16 and 18 are chosen to accomplish this concentration, which would not be obtained if flat reflective surfaces were used.

By aligning the axes of the two legs 31 and 32 of the U-shaped bulb 30 with lines dissecting the cusp 19, a minimum amount of light is reflected from one or the other of the legs of the bulb 30 to the other leg with a maximum amount of light output from the bulb being obtained directly or with a single reflection off of either of the compound curve reflecting surfaces 16 and 18. The orientation shown also provides a very uniform distribution of light from the specular reflecting surfaces 16 and 18; so that it is not necessary to employ a diffuser plate over the bottom of the fixtures 10 and 11 to prevent the casting of images on the work surface 12. Since a diffuser is not necessary, no light output or efficiency is lost by passing the light through such a diffuser. This results in a far more efficient fixture than would be the case if such a diffuser were necessary, as has been common in the past.

While the above description has been made in conjunction with a "built-in" system using two fixtures, a single fixture on one side of the work area also could be used, if desired. Also, the fixture or fixtures can be independent of the work area furniture and clamped to it or completely, separately stem-mounted.

The foregoing description taken in conjunction with the various figures of the drawing illustrating a preferred embodiment of the invention is to be considered illustrative only of the invention and not as limiting. Various changes and modifications will occur to those skilled in the art once they are presented with the embodiment which has been described. For example, the fixtures may be made in various dimensions, and depending upon the width of the fixtures and the distance of the fixtures from the work surface, different curvatures of the compound curves 16 and 18 may be employed in place of the curvatures shown in FIGS. 2 and 3. Also, if the additional diffusing characteristics of a semi-specular surface on the reflecting surfaces 16 and 18 is desired, this can be done without departing from the invention which has been described.

I claim:

1. A lamp fixture for concentrating illumination on a work area beneath and offset to the side of the fixture including in combination:

an open reflector, the transverse parallel vertical cross-sections of which are identical and comprise short and long compound curves joined together to form a cusp, with the long compound curve thereof extending toward the work area on which illumination is to be concentrated; and at least one elongated fluorescent bulb with its axis parallel to the cusp of said reflector and the axis thereof located on a line dissecting the cusp of said reflector, said line being substantially parallel to the offset beam of light produced by the fixture.

2. The combination according to claim 1 further including a second elongated fluorescent bulb having its axis parallel to the cusp of said open reflector and the axis thereof located on a line dissecting the cusp of said reflector.

3. The combination according to claim 2 wherein said elongated fluorescent bulbs comprise the first and second legs, respectively, of a U-shaped fluorescent tube.

4. The combination according to claim 1 wherein the lamp fixture is a task light arranged to be located above and to one side of a work area and the open reflector is generally parallel to the work area, and the curvatures of said compound curves of said reflector minimize multiple reflections from said bulb.

5. The combination according to claim 4 further including a second elongated fluorescent bulb with the axis thereof parallel to the cusp of said reflector and located on a line dissecting the cusp of said reflector.

6. The combination according to claim 5 wherein said at least one fluorescent bulb and said second fluorescent bulb are parallel to one another.

7. The combination according to claim 6 wherein said at least one fluorescent bulb and said second fluorescent bulb comprise the first and second legs of a single U-shaped fluorescent tube.

* * * * *